US005360164A

United States Patent [19]

Pape et al.

[11] Patent Number: 5,360,164

[45] Date of Patent: Nov. 1, 1994

[54] FUEL FILTER IN A FUEL INJECTION APPARATUS FOR INTERNAL COMBUSTION ENGINES

[75] Inventors: Werner Pape, Lyons; Francois Rossignol, Mornant, both of France

[73] Assignee: Robert Bosch GmbH, Stuttgart, Germany

[21] Appl. No.: 127,029

[22] Filed: Sep. 24, 1993

[30] Foreign Application Priority Data

Nov. 6, 1992 [DE] Germany ..... 4237469

[51] Int. Cl.[5] ..... F02M 57/00; F02M 57/02; F02M 59/44; F02M 51/00

[52] U.S. Cl. ..... 239/88; 239/575; 239/DIG. 23; 210/172; 210/416.4; 210/446; 210/451

[58] Field of Search ..... 239/88–92, 239/95, 96, 575, DIG. 23; 210/172, 416.1, 446, 451

[56] References Cited

U.S. PATENT DOCUMENTS

| | | | |
|---|---|---|---|
| 4,392,672 | 7/1983 | Deckard | 239/88 |
| 4,540,122 | 9/1985 | Teerman | 239/88 |
| 4,565,319 | 1/1986 | Potter | 239/88 |
| 4,572,433 | 2/1986 | Deckard | 239/96 |
| 4,618,095 | 10/1986 | Spoolstra | 239/90 |
| 4,811,715 | 3/1989 | Djordjevic et al. | 123/447 |
| 4,941,612 | 7/1990 | Li | 239/88 |

*Primary Examiner*—Karen B. Merritt

*Attorney, Agent, or Firm*—Edwin E. Greigg; Ronald E. Greigg

[57] ABSTRACT

A fuel injection apparatus for internal combustion engines, having a pump piston, axially guided in a cylinder bore of a pump housing, driven in a reciprocating manner by a cam drive; the pump piston defines a pump work chamber with its face end. The pump work chamber communicates with an injection valve via a pressure conduit and fuel from a reservoir is fed in and removed via a fuel line that has a feed pump; the triggering of the supply onset and end of supply of the unit fuel injector is achieved by means of a magnet valve inserted in the feed line in the region of the pump housing. In order to prevent the deposit of dirt particles in the pump, the unit fuel injector has a fuel filter in the pump housing, which is inserted in a diversion chamber below the magnet valve, and upstream of which a baffle plate is provided in the direction of the magnet valve to protect the filter from the intense diversion stream.

13 Claims, 3 Drawing Sheets

FUEL FILTER IN A FUEL INJECTION APPARATUS FOR INTERNAL COMBUSTION ENGINES

BACKGROUND OF THE INVENTION

The invention is directed to improvements in fuel injection apparatus for an internal combustion engine. In a fuel injection apparatus of this kind, disclosed in U.S. Pat. No. 4,392,612, a pump piston axially guided in a cylinder bore of a pump housing is driven by a cam drive in a reciprocating manner. With its face end remote from the cam drive the pump piston defines a pump work chamber in the cylinder bore into which a fuel supply line discharges and which is connected via a pressure conduit to a protruding injection valve in the combustion chamber of the internal combustion engine to be fed. Thus, the quantity of fuel to be injected as well as the beginning of the high pressure delivery of the fuel found in the pump work chamber and therefore the beginning of the injection is regulated via the diversion process by means of a magnet valve disposed in the fuel feed line that opens on either end, which is triggered dependent upon the engine to be fed.

Since the fuel injection apparatus is highly sensitive to dirt particles due to an exact fit, the partially very small throughput cross sections, and the high working pressures, a fuel filter is inserted in the part of the fuel line of the known unit fuel injector that extends in the pump housing between the feed pump or the reservoir and the magnet valve. To that end, the pump housing was widened at the part which carries the magnet valve and a receiving chamber was provided for a filter insertion, which is held by means of the now relatively large screw neck of the fuel feed line.

The disposition of this fuel filter has, however, the disadvantage that it requires additional space in the unit fuel injector, which in modern internal combustion engines is not frequently available. Furthermore, the total weight of the unit fuel injector also is increased by means of the additional space, in addition to the manufacturing expenditure.

OBJECTS AND SUMMARY OF THE INVENTION

It is an object of the fuel injection apparatus for internal combustion engines as disclosed herein to provide the advantage that, because of the disposition of the fuel filter in the existing dispersion chamber below the magnet valve, as disclosed in German published Application No. 40 10 450.8, no additional space is necessary to accommodate it. This integration of the filter in the known unit fuel injector has the additional advantage of preserving flexibility with regard to the location and manner of the connection of the fuel line to the unit fuel injector.

It is another object of the invention to protect the fuel filter in the diversion chamber from being destroyed by the diversion stream emerging at high energy at the end of the high-pressure delivery by providing a baffle device advantageously connected downstream of the fuel filter, which baffle device first deflects or swirls the intense diversion stream and then turns it so that it strikes the fuel filter in an optimal manner.

The fuel filter is embodied variously as a disk filter, a filter sleeve, or a plate filter; in addition to a simple availability these versions have the advantage that they can be optimally adapted to each requirement.

The baffle device is embodied of variously formed baffle plates, which advantageously have staggered flow openings and so prevent the intense diversion stream from directly striking the filter. The baffle plates, moreover, are adapted to the contour of the receiving chamber so as to prevent the fuel from bypassing the filter and to assure that the fuel stream strikes the filter in an optimal manner.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
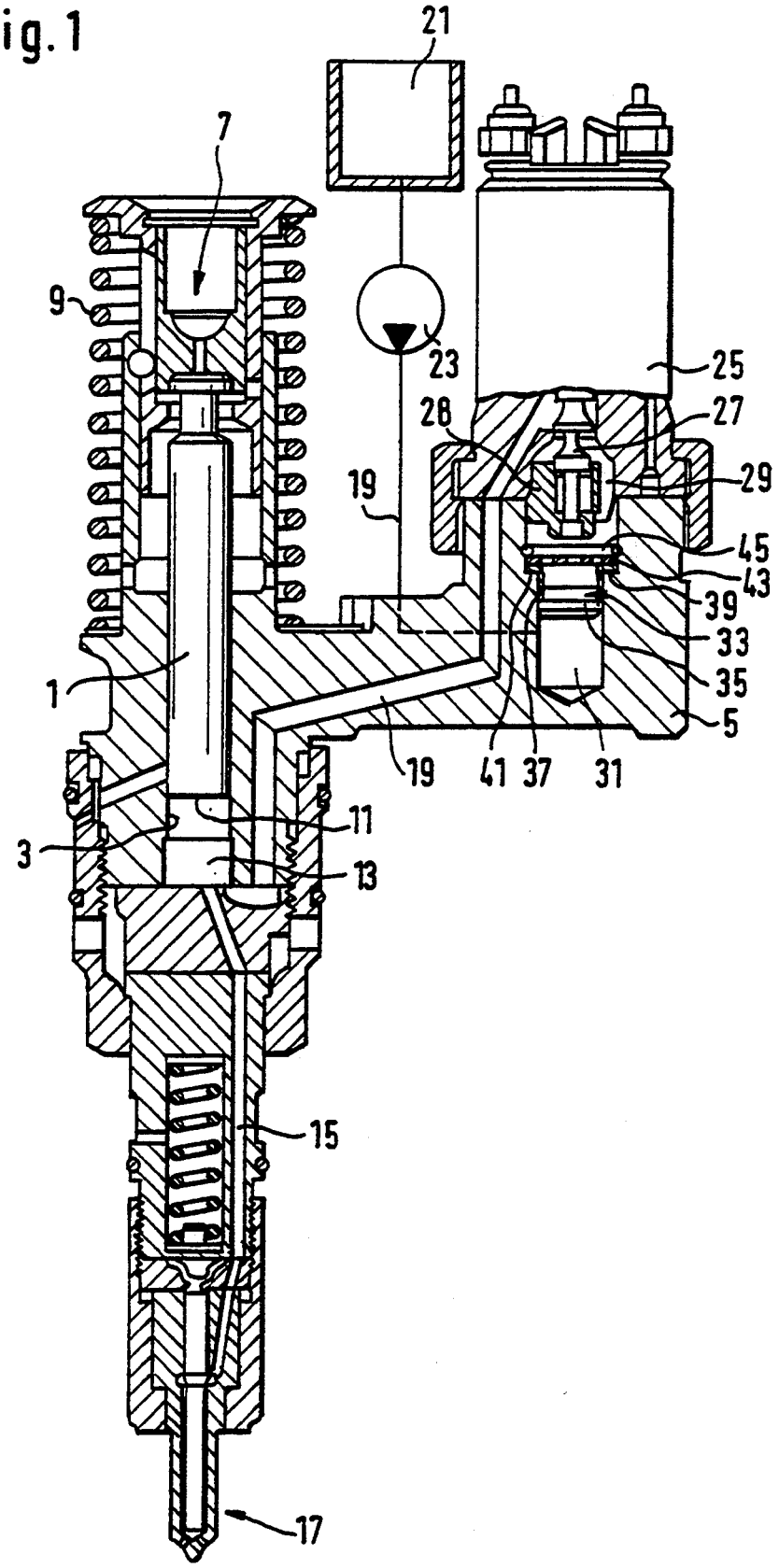
FIG. 1 shows a longitudinal section of a unit fuel injector, in which a disk filter is inserted in the diversion chamber below the magnet valve with a baffle plate upstream of the filter.

In the unit fuel injector shown in FIG. 1, of which only the areas essential to the invention are described, a pump piston 1 is axially guided in a cylinder bore 3 of a pump housing 5 and is driven axially inward contrary to a restoring spring 9 by a cam drive 7 not shown in detail. With its face end 11 remote from the cam drive 7, the pump piston 1 defines a pump work chamber 13 in the cylinder bore 3, out of which a pressure conduit 15 leads which connects the pump work chamber 13 to an injection valve 17, which protrudes into a combustion chamber of the engine to be fed.

Furthermore, a fuel feed line 19, in which a feed pump 23 and a magnet valve 25 are disposed, leads out of a schematically shown reservoir 21 and feeds into the pump work chamber 13. Since the filling as well as the supply onset and the end of supply are controlled via the magnet valve 25 in the fuel line 19, the magnet valve 25 opens in both directions; during the diversion process, a portion of the fuel flows out of the pump work chamber 13 under the feed pressure of the pump piston back into the reservoir 21, bypassing the feed pump 23, via a bypass line not shown, which has a check valve.

The magnet valve 25 is flange-mounted on the pump housing 5 so that its valve closing member 27, disposed parallel with the pump piston 1, protrudes into the pump housing 5 with a valve body 28; the valve body 28 has a through opening 29, which makes it possible for the fuel to flow through the open magnet valve 25, in other words when the valve member 27 is lifted from its seat in the magnet valve housing. In order to prevent the complete return flow of the highly pressurized fuel exiting the pump work chamber 13 back into the reservoir 21 during the diversion process as well as the pressure wave oscillations connected with this, a diversion chamber 31, which functions as a reservoir, is disposed in the connection to the valve member 27 of the magnet valve 25, axial to this on the side of the fuel line 19 remote from the pump work chamber 13; this diversion chamber 31 is embodied as a space having an enlarged cross section opposite the fuel line 19 in the pump housing 5, into which the part of the fuel line 19 connected with the fuel feed pump 23 feeds; after the flow, the diversion stream is directed at the valve member, coaxial to it by means of the opening cross section 29 and, as a result, the fuel flows into the diversion chamber 31 nearly axially.

A fuel filter 33 is disposed in the diversion chamber 31 to prevent the deposit of dirt particles entrained in the fuel in the fuel line 19, the pressure line 15, or on guide surfaces of any moving parts. In the first exemplary embodiment shown in FIG. 1, this fuel filter 33 is embodied as a disk filter screen 35, disposed in the part of the fuel line 19, embodied as a stepped bore, going out from the blind bore part on the side of the feed pump; the outer circumference of the disk filter screen 35 is sealingly and axially guided and secured in a guide sleeve 37, which, for its part is inserted in the diversion chamber 31 and rests against a shoulder 41 of the diversion chamber 31 via a flange 39. On the side facing the magnet valve 25, a baffle device rests against the flange 39 of the guide sleeve 37, which is embodied by means of a disk-shaped baffle plate 43, having through bores, which for its part is held in contact with the guide sleeve 37 by a securing ring 45, which is guided in a groove in the diversion chamber 31.

This baffle plate 43 is provided with the disk filter screen 35 to prevent a direct exposure of the filter to the full brunt of the fuel flowing out under high pressure via the magnet valve 25 under high pressure, thus extending the life of the filter. It is especially advantageous to insert the disk filter screen 35 and the baffle plate 43 with a minor amount of play in order to achieve different arrival points for the fuel that are changed as a result of an independent rotation of these parts caused by the fuel flow.

Figure 2:
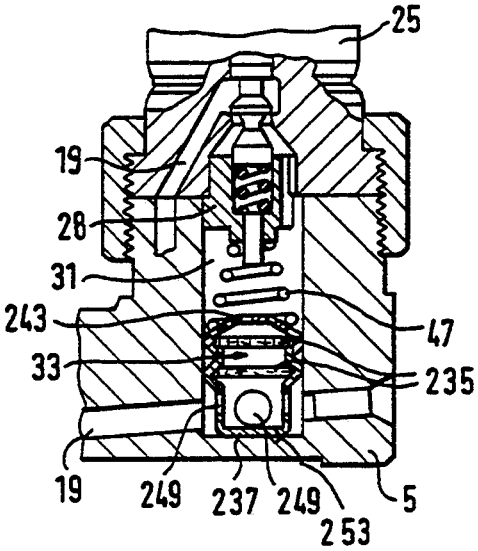
FIG. 2 shows a second exemplary embodiment of a disk filter and an installed position of the rotary disk filter in the diversion chamber, analogous to FIG. 1.

FIG. 2 shows an exemplary embodiment, which differs from that described in FIG. 1 in the embodiment of the fuel filter 33 and of the baffle device that it is provided with; here it is sufficient to embody the diversion chamber 31 as a simple cylindrical bore.

The fuel filter 33 is embodied by means of two disk filter screens 235 disposed behind one another, which are axially secured and guided in a closed guide sleeve 237, which is embodied having bellows-shaped ring-shaped recesses in its middle region, which hold the filter disks 235. The closed-bottomed guide sleeve 237 is held in contact with the bottom 253 of the diversion chamber 31 by means of a spring 47, which is supported on the valve body 28; in the underside remote from the spring 47, the guide sleeve 237 has radial outlet bores 249 for the fuel to flow through. The face end of the guide sleeve 237, oriented toward the spring 47, is slightly inclined toward the middle and provided with through bores, which make possible the fuel entry into the guide sleeve 237; a closing piece on the face end of the guide sleeve 237 serves both as a baffle plate 243, which breaks up the intense diversion stream, and at the same time as a guide and bearing face for the spring 47.

Figure 3:
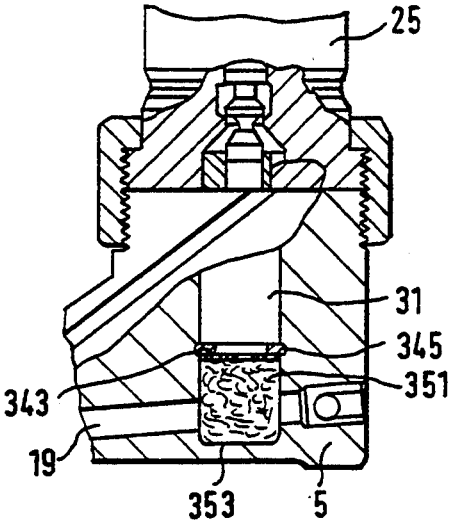
FIG. 3 shows a third exemplary embodiment in which the filter is embodied as a ball of wire.

FIG. 3 shows an exemplary embodiment in which the fuel filter, which is inserted in the diversion chamber 31 under the magnet valve 25, is embodied as a wire ball filter screen 351, which is limited toward the magnet valve 25 by means of a baffle plate 343 and held axially in contact with the bottom 353 of the diversion chamber 31 by means of a securing ring 345. This version has the advantage of a very simple production and a high filter effect as a result of the highly effective filter surface. A porous sintered part can also be used here.

Figure 4:
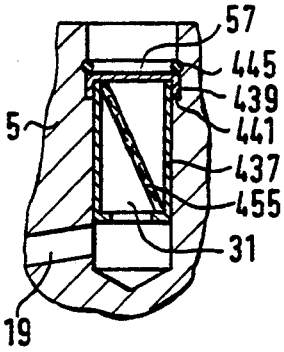
FIG. 4 shows a filter plate inserted on an incline.

FIG. 4 shows a fourth exemplary embodiment of a fuel filter 33 in the form of a filter screen plate 455, which is inserted obliquely in a guide sleeve 437, whose upper, closed face end oriented toward the magnet valve 25 is provided with through openings and consequently takes on the function of a baffle device. The guide sleeve 437 is held in contact with a shoulder 441 of the diversion chamber 31 via a securing ring 445 with a flange 439, in a manner analogously to that shown in FIG. 1.

Figure 5:
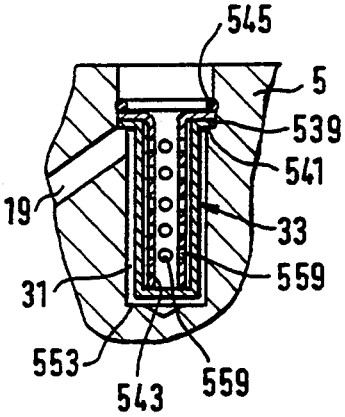
FIG. 5 shows a cup-shaped filter insert.

FIG. 5 shows an exemplary embodiment of a cup-shaped fuel filter 33, which is suspended on a shoulder 541 of the diversion chamber 31 via a flange 539 on the open end, so that it points with its open end toward the magnet valve 25 and continues down toward the bottom 553 of the diversion chamber 31, spaced apart from its wall. A baffle plate 543, which has the same cup shape as the fuel filter 33, is inserted into the open end of the fuel filter 33; its outer diameter is smaller than the inner diameter of the cup-shaped fuel filter 33, so that when the cup-shaped baffle plate 543 is inserted, a gap remains between the two parts, via which fuel emerging from the through openings 559 on the circumference of the cup-shaped baffle plate 543 can be distributed over the entire filter surface of the filter 33. Here too, the fuel filter 33 and the baffle plate 543 are axially secured via a securing ring 545.

Figure 6:
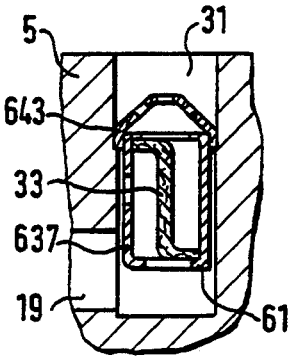
FIG. 6 shows a filter screen having oppositely and perpendicularly disposed extremities in the receiving chamber.

FIG. 6 shows an exemplary embodiment of a fuel filter 33 having oppositely and perpendicularly disposed extremities guided in a guide sleeve 637, which has ends 61 that are angled inward. The fuel flows chiefly through the axial openings of the guide sleeve 637, but in case of the installation of the guide sleeve 637 with play between it and the wall of the diversion chamber 31, it can also flow via a further radial bore in the guide sleeve 637. A baffle plate 643 placed upstream of the guide sleeve 637 in this case is embodied cone-shaped facing toward the magnet valve 25, and has through bores as in the previous exemplary embodiments.

Figure 7:
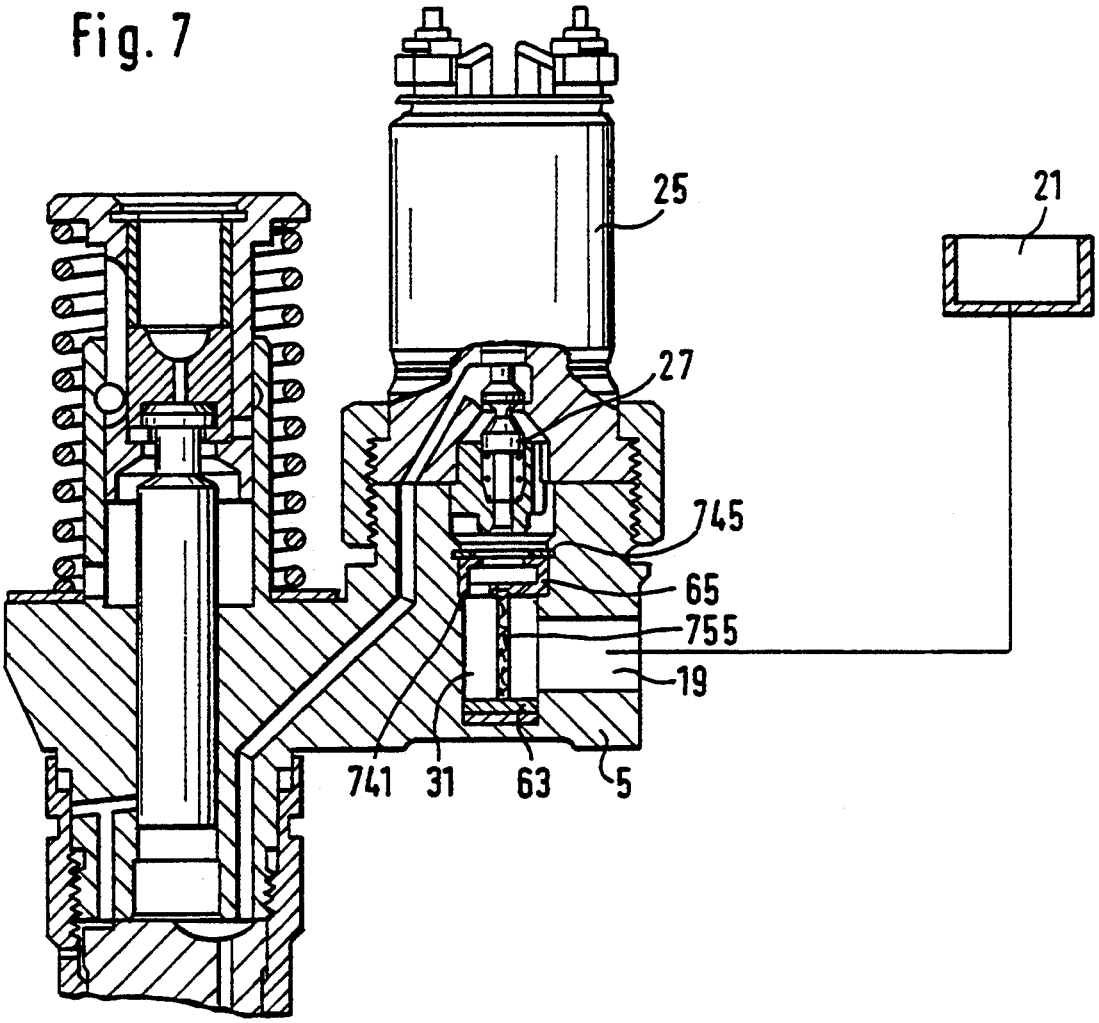
FIG. 7 shows a further exemplary embodiment, in which the filter is embodied as a vertically disposed filter plate, upstream of which a sleeve-shaped baffle device is provided.

FIG. 7 shows a seventh exemplary embodiment of the fuel filter 33 in the form of a filter screen plate 755, disposed longitudinally to the cylinder-shaped diversion chamber 31, which on its lower end, remote from the magnet valve 25, is pivotably connected and guided in a disk 63, and on its other, upper end is pivotably connected and guided in a baffle device in the form of a closed sleeve 65, which for its part is held in contact with a shoulder 741 via a securing ring 745. The filter screen plate 755 is guided sealingly with its vertical defining edges against the wall of the diversion chamber 31 and disposed so that the part of the fuel line 19 leading to the reservoir 21 feeds into the diversion chamber 31 at right angles to the filter screen plate 755. For a directed fuel supply to the side of the filter screen plate 755 facing away from the part of the fuel line 19 leading to the reservoir 21, the sleeve 65 has one through-bore respectively in its two ends, which are offset in respect to each other and one of which in the end facing the filter screen plate 775 is disposed on the side of the filter plate 755 facing away from the part of the fuel line 19 to the reservoir 21, while the other through-bore disposed in the opposite end is offset in such a way that the fuel stream cannot flow directly through the sleeve 65, but instead is reversed in the sleeve 65.

Figure 8:
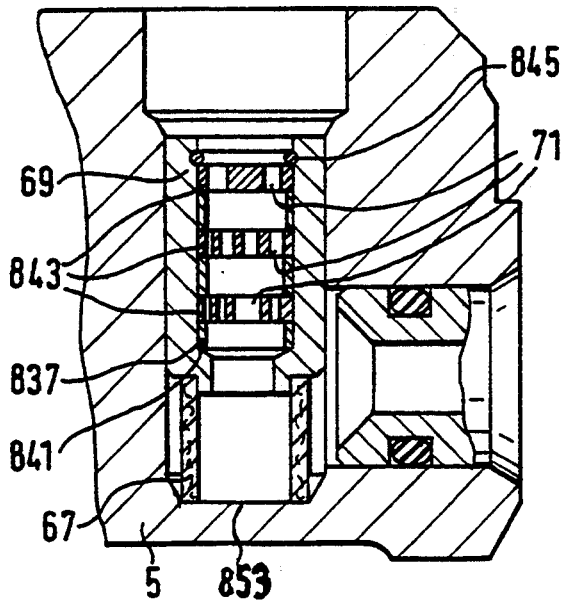
FIG. 8 shows an eighth exemplary embodiment analogous to that in FIG. 7, in which the filter inserted in the diversion chamber is embodied as a sleeve; a baffle device is placed upstream of this fuel filter, as in all of the other modifications.

FIG. 8 shows an exemplary embodiment in which the fuel filter 33 is embodied as a filter sleeve 67, which is inserted with play between itself and the cylinder wall into the diversion chamber 31, and which is held in contact with the bottom 853 of the diversion chamber 31 via a cylinder-shaped spacer 69. Analogous to FIG. 7, the part of the fuel line 19 that leads to the reservoir 21 feeds into the diversion chamber 31 near the bottom region of the filter screen 67. In order to prevent the intense diversion stream from directly striking the filter sleeve 67, a baffle device is disposed inside the cylinder-shaped spacer 69; this baffle device consists of several disk-shaped baffle plates 843 arranged in series, each of which has through bores 71, which are offset from each other and whose diameters are reduced from baffle to baffle. To achieve a secure positioning, the individual baffle plates 843 are disposed in a guide sleeve 837, which is fixed in the spacer 69 via a shoulder 841 and a securing ring 845.

In the described exemplary embodiments it is therefore possible to position a fuel filter 33 in the inside of the pump body 5 in such a way that neither its required space is increased nor the flexibility with regard to the location of the connection for the fuel line 19 is decreased.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection device for an internal combustion engine, having a pump piston guided in a cylinder bore (3) of a pump housing (5), the piston being driven axially back and forth by a cam drive (7) and with one face end of said piston, remote from the cam drive (7), defining a pump work chamber (13), said pump work chamber communicates via a pressure conduit (15) with an injection valve (17) that protrudes into the combustion chamber of the engine to be supplied with fuel via a fuel line (19) that communicates with a fuel supply tank (21) and has a feed pump (23), and for controlling a high-pressure pumping phase of the pump piston (1), an electromagnetic valve (25) is provided in the fuel line (19), said electromagnetic valve is adjoined, on a side remote from the pump work chamber (13) in a direction of the pump housing (5), by a region that forms a diversion chamber (31) in the fuel line (19) that extends within the pump housing (5), said diversion chamber has a larger cross section than the fuel line, a fuel filter (33) is inserted into the diversion chamber (31) in the pump housing (5) between the electromagnetic valve (25) and a part leading onward of the fuel line (19), the fuel flowing out of the electromagnetic valve emerges essentially in the same direction as an axis of the diversion chamber (31), which is embodied as a bore, and a baffle device (43) is disposed between the fuel filter (33) and the electromagnetic valve (25), said baffle device prevents a highly pressurized diversion stream from directly striking the fuel filter (33).

2. A fuel injection device according to claim 1, in which the fuel filter (33) is embodied as a single disk filter screen (35).

3. A fuel injection device according to claim 1, in which the fuel filter (33) is embodied as a wire ball filter screen (351).

4. A fuel injection device according to claim 1, in which the fuel filter (33) is embodied with oppositely and perpendicularly disposed extremities.

5. A fuel injection device according to claim 1, in which the fuel filter (33) is comprised of a filter screen plate (755) disposed along an axis of a cylinder-shaped space, which is embodied as said diversion chamber (31), dividing said cylinder-shaped space lengthwise; said cylinder-shaped space is provided with said baffle device in a form of a closed sleeve (65), having an entrance and an exit opening, said entrance and exit openings are offset from one another, in such a way that the entrance opening in the diversion chamber (31) is disposed on a side of the filter screen plate (755), remote from an exit of the fuel line (19) out of the diversion chamber (31).

6. A fuel injection device according to claim 1, in which the fuel filter (33) is embodied to be cup-shaped and is inserted with a gap between the fuel filter and the circumference walls of the diversion chamber (31), wherein said baffle devices comprises a baffle sleeve (543), having radial through bores (559) and a flange (539) that is angled outward, inserted into the cup-shaped fuel filter (33).

7. A fuel injection device according to claim 1, in which the baffle device is embodied as a plurality of disk-shaped baffle plates (843) placed axially from each other, having through bores (71), which are offset from one another, and whose diameters are reduced from baffle to baffle in a direction away from the electromagnetic valve (25) .

8. A fuel injection device according to claim 1, in which the baffle device is embodied as a baffle plate (243, 643), which is cone-shaped toward the electromagnetic valve (25) and has through openings.

9. A fuel injection device according to claim 1, in which the fuel filter (33) includes a plurality of disk filter screens (35).

10. A fuel injection device according to claim 1, in which the fuel filter includes two spaced disk filter screens.

11. A fuel injection device according to claim 1, in which the baffle device is embodied as a baffle plate (243, 643), which is vaulted toward the electromagnetic valve (25) and includes through openings.

12. A fuel injection device for an internal combustion engine, having a pump piston guided in a cylinder bore (3) of a pump housing (5), the piston being driven axially back and forth by a cam drive (7) and with one face end of said piston, remote from the cam drive (7), defining a pump work chamber (13), said pump work chamber communicates via a pressure conduit (15) with an injection valve (17) that protrudes into the combustion chamber of the engine to be supplied with fuel via a fuel line (19) that communicates with a fuel supply tank (21) and has a feed pump (23), and for controlling a high-pressure pumping phase of the pump piston (1), an electromagnetic valve (25) is provided in the fuel line (19), said electromagnetic valve is adjoined, on a side remote from the pump work chamber (13) in a direction of the pump housing (5), by a region that forms a diversion chamber (31) in the fuel line (19) that extends within the pump housing (5), said diversion chamber has a larger cross section than the fuel line, a fuel filter (33) is inserted into the diversion chamber (31) in the pump housing (5) between the electromagnetic valve (25) and a part leading onward of the fuel line (19), and the fuel filter (33) is embodied as a filter screen plate (455), which is inserted into the diversion chamber (31) oblique to its axis.

13. A fuel injection device for an internal combustion engine, having a pump piston guided in a cylinder bore (3) of a pump housing (5), the piston being driven axially back and forth by a cam drive (7) and with one face end of said piston, remote from the cam drive (7), defining a pump work chamber (13), said pump work chamber communicates via a pressure conduit (15) with an injection valve (17) that protrudes into the combustion chamber of the engine to be supplied with fuel via a fuel line (19) that communicates with a fuel supply tank (21) and has a feed pump (23), and for controlling a high-pressure pumping phase of the pump piston (1), an electromagnetic valve (25) is provided in the fuel line (19), said electromagnetic valve is adjoined, on a side remote from the pump work chamber (13) in a direction of the pump housing (5), by a region that forms a diversion chamber (31) in the fuel line (19) that extends within the pump housing (5), said diversion chamber has a larger cross section than the fuel line, a fuel filter (33) is inserted into the diversion chamber (31) in the pump housing (5) between the electromagnetic valve (25) and a part leading onward of the fuel line (19), and the fuel filter (33) is embodied as a sleeve-shaped filter screen (67).

* * * * *